United States Patent [19]

Boggs

[11] 4,365,368

[45] Dec. 28, 1982

[54] BATHING FACILITY

[76] Inventor: William H. Boggs, 407 W. Linden Ave., Miamisburg, Ohio 45342

[21] Appl. No.: 288,094

[22] Filed: Jul. 29, 1981

Related U.S. Application Data

[63] Continuation of Ser. No. 141,191, Apr. 28, 1980, abandoned.

[51] Int. Cl.[3] ..... A47K 3/22

[52] U.S. Cl. ..... 4/596; 4/524; 4/612; 4/614; 52/80

[58] Field of Search ..... 4/596, 597, 525, 607, 4/610, 524, 609, 612, 614; 52/80

[56] References Cited

U.S. PATENT DOCUMENTS

| | | | |
|---|---|---|---|
| 2,749,429 | 6/1956 | Wavell | 52/80 X |
| 2,881,306 | 4/1959 | Sherron | 52/80 X |
| 2,907,048 | 10/1959 | Gould | 4/597 |
| 2,911,654 | 11/1959 | Bruno | 4/607 |
| 3,007,178 | 11/1961 | Altman et al. | 4/525 |
| 3,054,118 | 9/1962 | Bullock | 4/607 |
| 3,111,208 | 11/1963 | Grossman | 4/607 X |
| 3,293,666 | 12/1966 | Casalmi | 4/525 |
| 3,359,573 | 12/1967 | Casebolt | 4/607 |
| 3,434,250 | 3/1969 | Kiekhaefer | 52/80 X |
| 3,763,608 | 10/1973 | Chamlee | 52/80 |
| 3,864,760 | 2/1975 | Bowen | 4/596 |

*Primary Examiner*—Henry K. Artis

*Attorney, Agent, or Firm*—Biebel, French & Nauman

[57] ABSTRACT

A transparent enclosure for a bathing facility such as a bath tub, tub-shower or shower stall, comprises a domed hood cylindrically and/or spherically curved about a radius substantially matching the width of the enclosure to confine the hot moist air from the hot water within the bathing facility and to cause it to circulate around the person of the user. The hood is made of three telescoping parts for adjustment to fit different lengths of tub and shower stall installations, and a riser is provided for use where the normal top of the enclosure would provide inadequate head room if the hood were mounted directly thereon.

5 Claims, 18 Drawing Figures

BATHING FACILITY

RELATED APPLICATION

This application is a continuation of application Ser. No. 141,191, filed Apr. 28, 1980, now abandoned, the disclosure of which is incorporated herein by reference.

BACKGROUND OF THE INVENTION

Warm water used in a tub or shower can heat the surrounding air to a temperature more comfortable for the bather than the temperature of the air in the rest of the bathroom unless the water is at such a temperature and in such volume as to heat the entire room, in which case steaming of mirrors and windows is likely to occur. This is true even in bathing facilities of the type provided with an enclosing front wall and/or door, due to the tendency of heated air to escape over the top of the enclosure. If this air is confined to the space immediately above the tub or other bathing facility, then the complete volume of air within the bathing facility would be relatively comfortably warm, particularly for a bather taking a long bath or shower.

Confinement of the air to the space between a bath tub and the ceiling wherein it is installed will minimize escape of water vapor into the remainder of the bathroom and correspondingly minimize steaming of mirrors and windows. This is particularly the case with the common type of bathing facility wherein a tub, shower or combination tub-shower is fitted between the back wall and end walls on one side or end of the bathroom, and the front of the facility is closed by one or more sliding doors supported on the front rim of the tub and by a rail extending between the end walls at a height some distance below the ceiling. In addition, the resulting increased comfort for the bather is achieved with minimum wasted heat into the rest of the room, and thus promotes economy of energy and water.

A forerunner of the present invention is disclosed in Bowen U.S. Pat. No. 3,864,760, which demonstrates an appreciation of the considerations outlined in the preceding paragraph. The primary object of the present invention is to provide an enclosure for the top of a bathing facility which will possess all of the advantages asserted in the Bowen patent for the enclosure disclosed therein, and which in addition is more practical to manufacture, easier to install, adaptable to a wider variety of installations than the Bowen enclosure, and more effective in the manner in which it collects and recirculates the heated vapors with respect to the person of the user within the bathing facility.

SUMMARY OF THE INVENTION

In accordance with the invention, it has been discovered that if an enclosure for the top of the bathing facility is constructed as a domed hood curved about a radius which substantially matches one-half the width of the tub or other facility, it is particularly effective in reflecting and focussing the heated moist air currents within the facility so as to cause them to circulate toward and about the person of the user.

These results are achieved with the enclosure for an essentially square shower stall by means of a spherically curved hood having its diameter of curvature substantially equal to the width of the enclosure. In the case of a bath tub facility, the hood is made with its main central portion cylindrically curved about a radius substantially equal to one-half the width of the bath tub, and with its end portions formed as approximately quarter-spheres of the same radius as the cylindrically curved central portion.

Because bath tub facilities vary in length and width over a substantial range, some degree of adaptability is provided in the enclosures of the invention by constructing them with peripheral flange portions by which they are supported on the walls of the bathing facility, and by initially making these flange portions of the maximum probable width so that they can be trimmed for somewhat smaller facilities. Preferably, however, the enclosures of the invention are provided as three-part assemblies, with the cylindrically curved central part having a telescoping fit with the spherically curved separate end portions for adaptation to a range of tub lengths.

Another variable dimension requiring consideration in accordance with the invention is the width of commonly used bath tub and shower enclosures, which would require that the domed hoods of the invention be produced in a variety of radii of curvature in order to maintain the relationship of that radius to the width of a bath tub as outlined above. In the practice of the invention, however, it has been determined that a 14-inch radius gives optimum results, and in order to maintain the height of the domed hoods of the invention uniformly of this value, they are provided in a variety of widths but with at least the central part of each curved portion conforming to a 14-inch radius. Where that radius is substantially less than one-half the width of the tub or shower, the hood is formed with flat sections connecting its curved portions with its periphery.

The invention also takes into consideration the fact that in existing bath tub facilities provided with a door or doors along the front edge of the tub, the rail which supports the door is usually at such height below the ceiling of the room that if the enclosure of the invention were mounted directly thereon, there would be insufficient head room for the average bather to stand erect while taking a shower. The invention accordingly provides a special form of enclosure incorporating a riser panel for mounting on the front wall rail of a bathing facility, which serves to support the front edge of the hood of the invention along with suitable brackets mounted on the back and end walls of the facility if it is not already provided with sufficiently high tiled or otherwise water-impervious supplemental walls to furnish such support.

Other advantages and objects of the invention will become apparent from the following descriptions of preferred embodiments of the invention and the drawings wherein they are illustrated.

DESCRIPTION OF THE PREFERRED EMBODIMENTS

Figure 1:
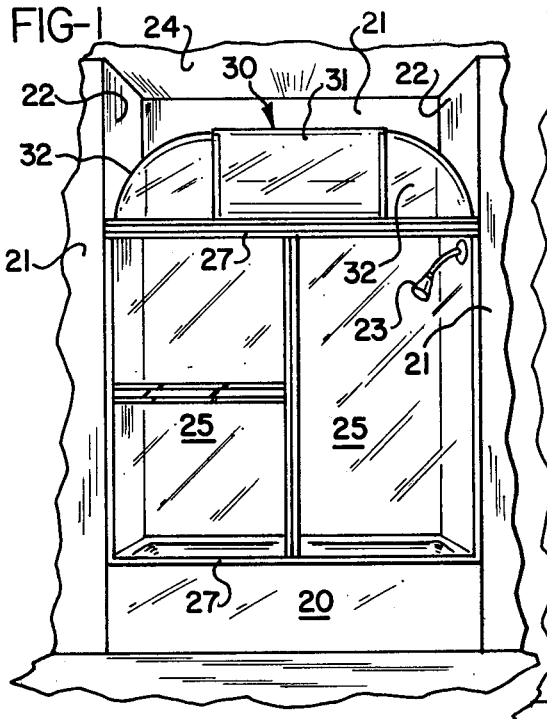
FIG. 1 is a front elevation of a typical installation of one embodiment of the invention in combination with a bath tub and shower having a slidably mounted front door.

In FIG. 1, a bath tub 20 is mounted in conventional fashion in a rectangular space formed by a back wall 21 and end walls 22 in a bathroom, and with a shower head 23 mounted on one of the end walls 22. The walls 21 and 22 extend to the ceiling 24 of the room, and the facility is also provided with a front wall comprising a pair of plastic or glass panels or doors 25, at least one of which is mounted for sliding movement on a track 27 extending along the front rim of the tub and with its upper edge guided by a similar track in a rail 27 extending between the side walls 21 at a height substantially below the ceiling.

Figure 5:
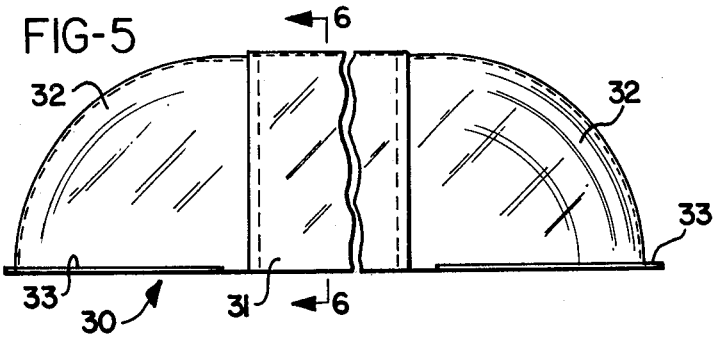
FIG. 5 is a side elevation of a three-piece domed hood in accordance with the invention.
Figure 6:
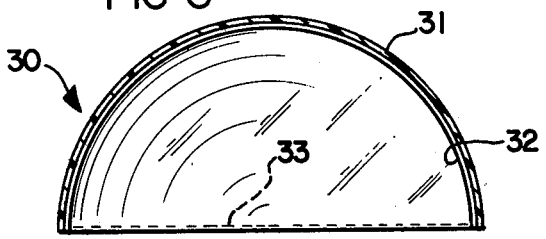
FIG. 6 is a section on the line 6—6 of FIG. 5.
Figure 7:
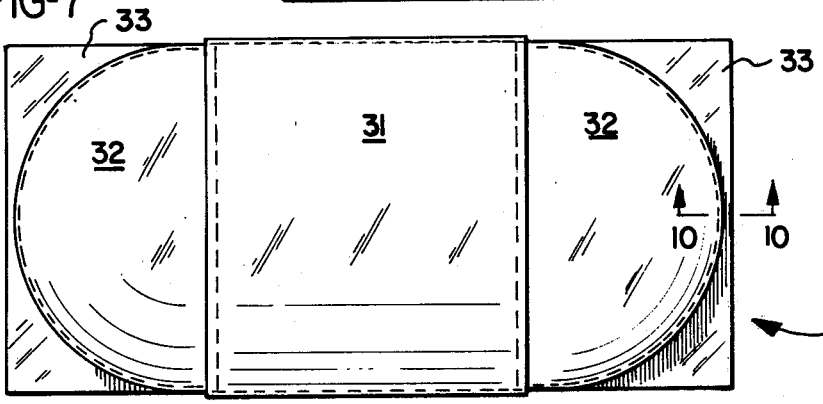
FIG. 7 is a plan view of the hood of FIGS. 5-6.

A domed hood 30 constructed in accordance with the invention forms an enclosure for the bathing facility in FIG. 1 and is shown in detail in FIGS. 5-7. The hood 30 is formed in three parts, a semi-cylindrical main body part 31 and two identical end parts 32, each of which includes a spherically curved dome portion and a flange 33 projecting at right angles from its bottom rim and having square corners so that from above, the hood as a whole is essentially rectangular. All of these parts are formed of a hard and preferably clear plastic such as Plexiglass, and of sufficient thickness for adequate rigidity, preferably one-quarter inch and not less than one-eighth inch.

Each of the end parts 32 is molded as essentially a quarter-sphere curved about a radius substantially matching one-half the width of the top of the tub 20, and also including a short cylindrically curved portion at its inner end. As already pointed out, optimum results have been obtained with this radius maintained at substantially 14 inches. The central part 31 is cylindrically curved about substantially the same radius, and preferably the inner radius of part 31 will match the outer radius of the end parts 32 so that it can be smoothly fitted over and in telescoping relation with the inner ends of the end parts 32 as shown in FIGS. 5 and 7.

Figure 10:
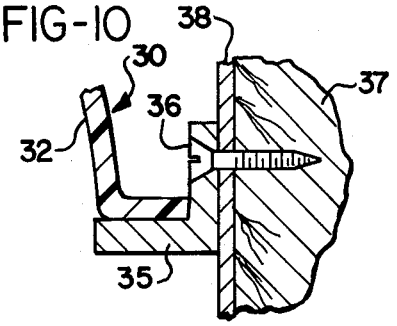
FIG. 10 is an enlarged fragmentary section taken as indicated by the line 9—9 of FIG. 6 to show supporting bracket structure for the hood of the invention.

The hood 30 is mounted in the position shown in FIG. 1 by setting it on the top of the rail 27 and additional supports on the walls 21 and 22. If the bathing facility initially includes back and end wall portions of the same height as the rail 27, which occurs relatively frequently in conventional tub-shower installations, the hood may simply be set on top thereof, with or without the addition of a sealing material, such as a clear silicone cement, along its edges. Otherwise, separate supporting brackets, such as aluminum angle bars 35, may be used as shown in FIG. 10, the bars 35 being mounted at the same level as rail 27 by screws 36 set in wall studs 37 through the wall covering 38. Preferably an additional length of angle bar is similarly mounted on the rail 27, and secured thereto by silicone cement to retain the front edge of the hood 30.

The end flanges 33 are initially made of an appropriate dimension lengthwise of the hood for trimming to fit the distance between the end walls 22, but it has been found unnecessary for a substantial range of installations to provide any flanges on the central part 31. It has also been found in use that the weight of the part 31 will normally hold it in proper position without otherwise securing it in place, although a clear cement may be used for this purpose.

Figure 8:
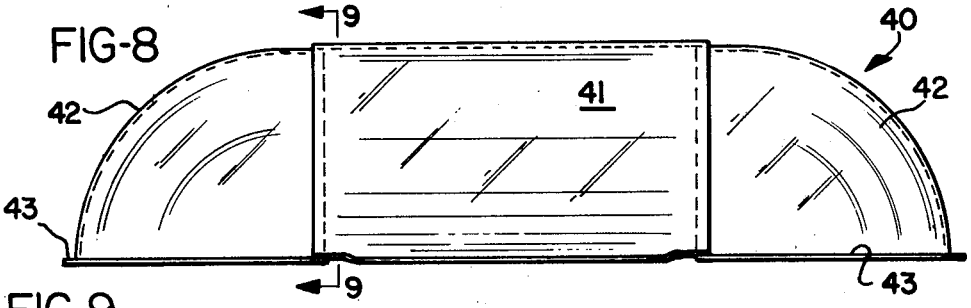
FIG. 8 is a view similar to FIG. 5 showing a modified construction of hood in accordance with the invention.
Figure 9:
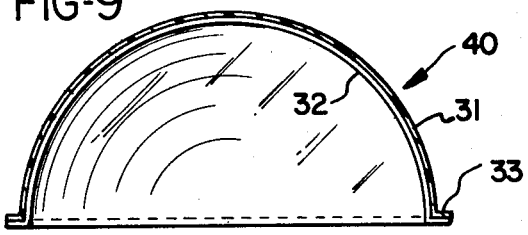
FIG. 9 is a section on the line 9—9 of FIG. 8.

FIGS. 8 and 9 show a modified construction of hood 40 which is essentially the same as shown in FIGS. 5-7 except that the central part 41 and end parts 42 have flanges 43 and 44 projecting outwardly from their lower edges to adapt them for mounting on a bathing facility for which the unflanged form of FIGS. 5-7 would be too narrow. Satisfactory results have been obtained with the flanges 44 on the central portion 41 each three-quarters inch in width, thereby adapting the unit to fit an installation as wide as 30 inches over all.

As shown in FIG. 8, the end portions of the flanges 44 are offset vertically to telescope over the complementary end portions of the flanges 43 on the end parts 42. This flanged construction is also particularly useful as part of a completely new installation, since by means of the flanges, the unit can be mouned permanently in position with the flanges overlapped by the wallboard or other material used to finish the upper ends of the back and end walls of the space in which the facility is installed.

Figure 2:
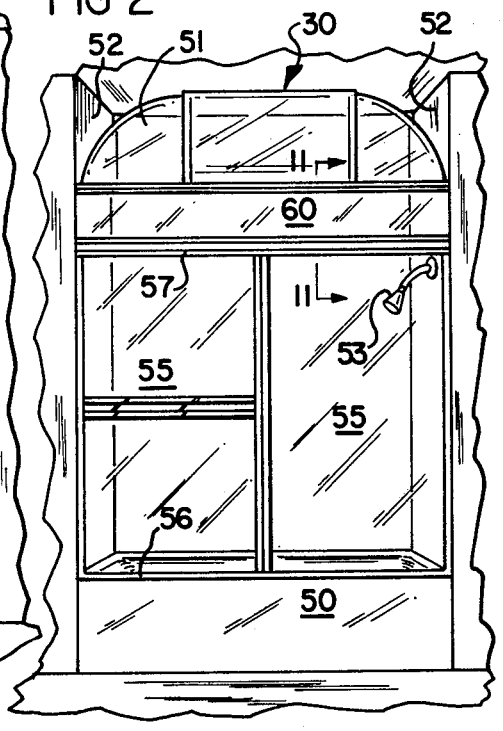
FIG. 2 is a view similar to FIG. 1 of another installation in accordance with the invention wherein the domed hood is mounted with the aid of a riser panel above the front door rail to provide increased head room within the enclosure.

FIG. 2 shows an installation essentially the same as already described in connection with FIG. 1 except that the existing tub-shower unit is assumed to have the rail supporting the top of the front door at too lower a level to provide adequate head room below the hood 30 of the invention if it were mounted directly on that rail, or if the shower head is so high on the wall that it would interfere with mounting the hood on the rail. More specifically, the bath tub 50 in FIG. 2 is set in a rectangular space formed by a back wall 51 and end walls 52, and a shower head 53 is mounted on one of the end walls. The front wall includes a pair of glass or plastic panels or doors 55 mounted between a track 56 extending along the front rim of the tub and by a similar track in the rail 57.

Figure 11:
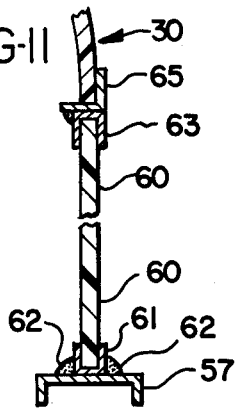
FIG. 11 is an enlarged fragmentary section on the line 11—11 of FIG. 2.

Provision is made in accordance with the invention for mounting the enclosure 30 at a higher level than the rail 57, by means of a riser panel 60 which may be of the same one-quarter inch thick plastic material as the dome 30. As shown in detail in FIG. 11, the riser panel 60 has its lower edge fitted into a small channel 61, preferably of aluminum, set on the top of the rail 57 and secured thereto by suitable caulking 62 such as silicone sealant.

The upper edge of the panel 60 is provided with a similar channel 63 which serves as the direct support for the front edge of the hood 30. Preferably, however, an aluminum angle 65 is first set on the channel 63 and secured thereto by silicone sealant to retain the front edge of the hood 30 in place. The ends and back edge of the hood 30 are supported in the manner shown in FIG. 10, by angle brackets fixed on the walls 51 and 52 in horizontal alignment with the angle 65.

It has been found that hoods of the dimensions described, within the range provided by the flanges in the form shown in FIGS. 8–9, will fit substantially all tub installations. Shower installations, however, are commonly built somewhat wider than bath tubs, generally in the range of 32 to 34 inches, and the hoods of the invention shown in FIGS. 12–17 are designed to fit the common size and shapes of shower stalls.

Figure 3:
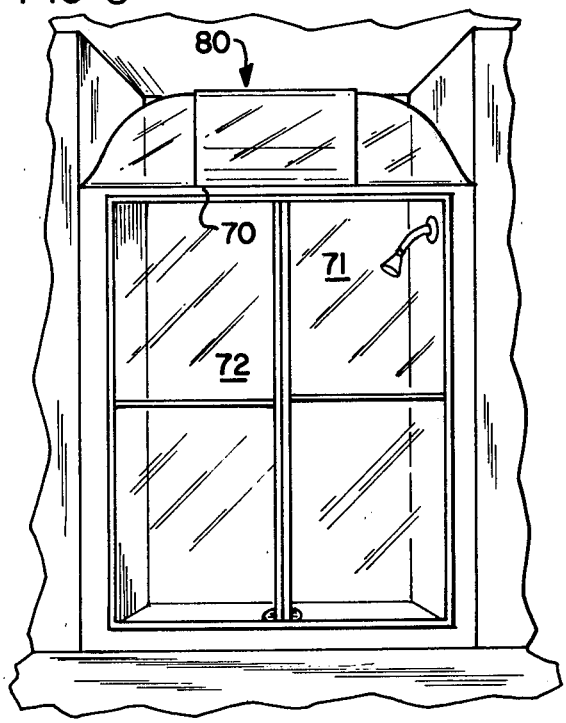
FIG. 3 is a view similar to FIG. 1 showing a domed hood in accordance with the invention on a rectangular shower stall provided with a slidable front door panel.
Figure 12:
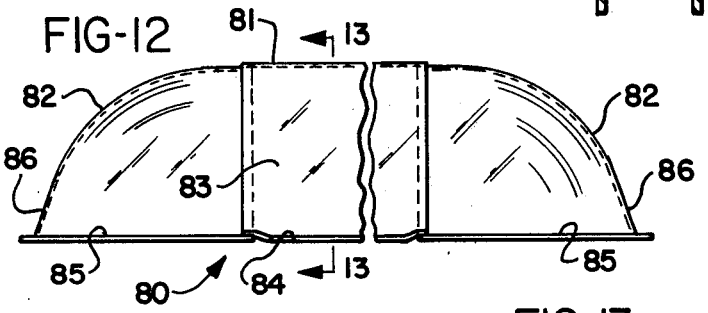
FIG. 12 is a view similar to FIG. 1 showing a hood in accordance with the invention for use on a wider tub or shower stall then the forms in FIGS. 5-7.
Figure 13:
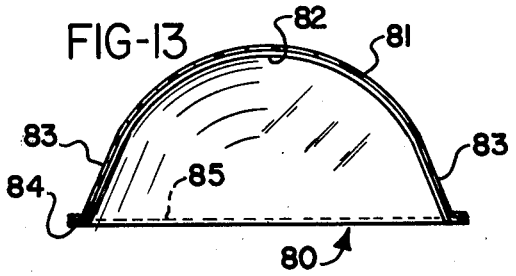
FIG. 13 is a section on the line 13—13 of FIG. 12.

Thus the hood 80 in FIGS. 12–13 is particularly designed to fit a rectangular shower stall of the type illustrated in FIG. 3, which is a rectangular stall having a front frame 70 in which are mounted a fixed transparent panel 71 and a sliding panel or door 72. The hood 80 shown in FIGS. 12–13 is designed to fit such a stall of a width of about 32 inches, and to be mounted either directly thereon if the stall is free-standing, or on the top of frame 70 and brackets on the surrounding back and end walls of the room if the stall is recessed like the tub-shower facilities in FIGS. 1 and 2.

Referring particularly to FIGS. 12–13, the hood 80 includes a center part 81 and end parts 82, and the center section of part 81 has its major portion cylindrically curved about a radius of 14 inches centered in the plane containing its lower edge. However, the width of the part 81 as measured between the inside edges of its oposite rims is intended to be inches, and this requires that its sides include straight portions 83 substantially tangent to the edges of its cylindrically curved portion. In addition, the center part 81 includes flanges 84 each approximately one inch in width which interfit with the flanges 85 on the end parts 82.

The ends parts 82 are formed to complement the center part 81 and to fit in telescoping relation therein. Thus each of the end parts 82 includes a spherically curved main portion having an outer radius of approximately 14 inches, but it also includes a portion 86 which is straight in vertical section and connects the spherically curved portion with the rim. In addition, each of the end parts 82 includes an inner end portion which is partly cylindrically curved and partly straight to match and telescope within the adjacent end of the center part 81.

Figure 14:
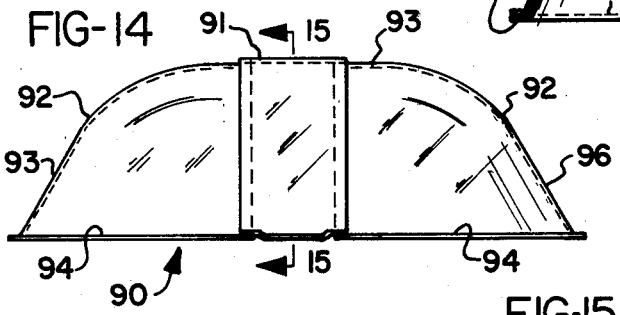
FIG. 14 is a view similar to FIG. 12 showing another modification of the hood of the invention for use particularly on a rectangular shower stall.
Figure 15:
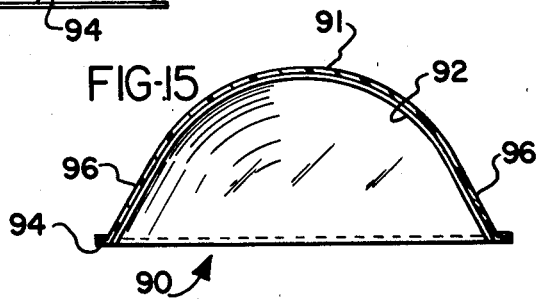
FIG. 15 is a section on the line 15—15 of FIG. 14.

FIGS. 12–13 illustrate a hood 90 designed particularly for use on shower stalls like the stall in FIG. 3 but of too great a depth to receive the hood 80, a standard depth being 34 inches. The center part 91 and end parts 92 in FIGS. 14–15 are therefore formed similarly to the corresponding parts in FIGS. 12–13, except that in order to provide a greater width while maintaining the preferred 14-inch radius of curvature, the center part 91 has a cylindrically curved main portion of smaller angular dimensions than the part 81, and the straight portions 93 which connect the curved portion with the rim are correspondingly longer than in FIGS. 12–13 to provide an inside width for the part 91 of approximately 32 inches, which is supplemented by flanges 94 each approximately one inch in width. The end parts 92 are formed similarly to the end parts 82 except that they also have longer straight side portions 96 connecting their curved portions with their rims.

Figure 4:
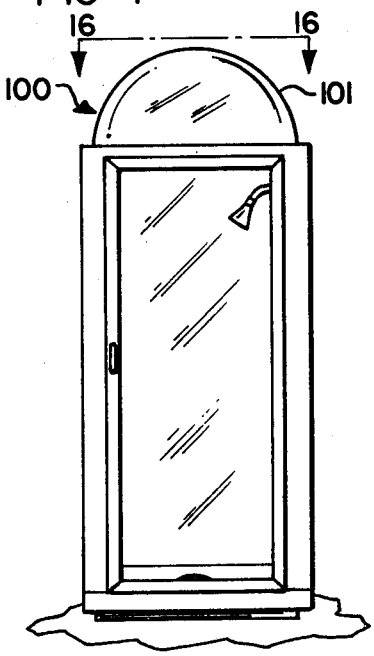
FIG. 4 is a view similar to FIG. 1 showing a domed hood in accordance with the invention with a square shower stall having a hinged front door.
Figure 16:
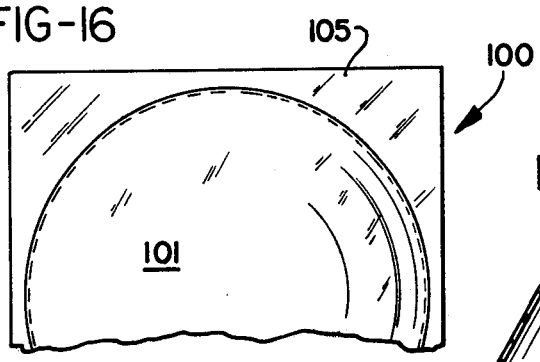
FIG. 16 is a fragmentary plan view of a hood in accordance with the invention for use on a square shower stall.

FIG. 4 shows a hood 100 in accordance with the invention mounted on a square shower stall, which may be either free standing or recessed in a wall similarly to the other installations described in connection with FIGS. 1–3. As shown in FIG. 16, the hood 100 includes a semi-spherical main body 101 and a rectangular flange 105 by which it may be mounted on the stall in FIG. 4 as described in connection with other installations.

Figure 18:
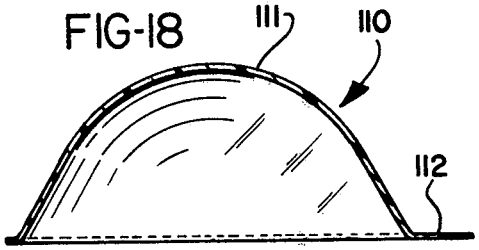
FIG. 18 is a section on the line 18—18 of FIG. 17.
Figure 17:
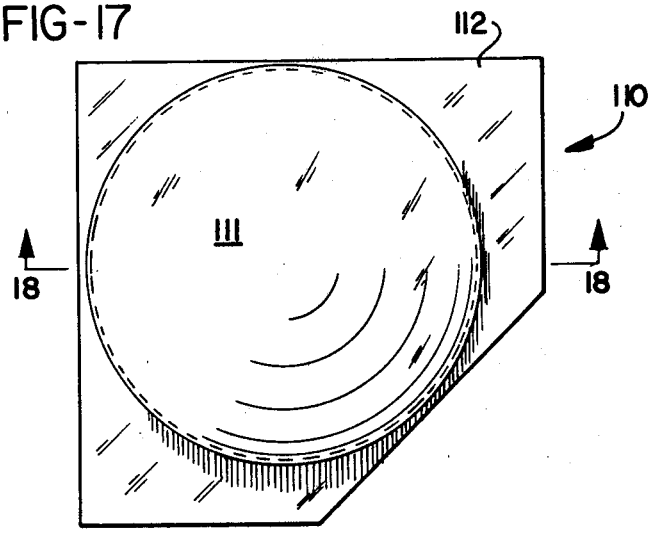
FIG. 17 is a plan view of a hood in accordance with the invention for use on a shower stall having an oblique side.

FIGS. 17–18 show a hood 110 in accordance with the invention particularly designed for mounting on a shower stall of the type having its door mounted in oblique relation with two sides of an otherwise rectangular stall. The dome 110 accordingly comprises a semi-spherical main body 111 and a peripheral flange 112 which extends to a greater extent on two sides of the main body than on the other two and has one oblique side to match the doorway in the shower stall for which it is intended.

While the products herein described constitute preferred embodiments of the invention, it is to be understood that the invention is not limited to these precise products, and that changes may be made therein without departing from the scope of the invention.

What is claimed is:

1. An enclosure for the top of a domestic bathing facility having a back wall, a pair of side walls and an openable front wall to retain the heat vapors emanating from hot water delivered to the interior of the facility, comprising:

(a) a body of plastic material including a domed main central portion at least the major portion of which is curved about a radius not less than nor substantially greater than one-half the width of said facility between said front and back walls to direct and recirculate hot vapors downwardly therefrom toward the central upper portion of the interior of said facility, and (b) a flange extending around at least a portion of the periphery of said body for mounting said enclosure on said facility walls.

2. An enclosure for a bathing facility as defined in claim 1 further comprising:

(a) a main body portion at least the major part of which is cylindrically curved about a radius centered substantially in the plane of said flange, (b) end portions each of which define substantially one-quarter of a sphere of substantially the same radius as said cylindrically curved main body part, and (c) peripheral flanges on said end portions for mounting on said facility walls.

3. An enclosure for a bath tub facility as defined in claim 2 wherein said main body portion and said end portions are separate parts, said main body part is cylindrically curved throughout its entire length, and the opposite ends of said body part are in telescoping engagement with said end parts to complete said enclosure.

4. An enclosure as defined in claim 1 for a bath tub facility including a bath tub and wherein said front wall includes a rail extending between said side walls above the front rim of said tub and corporating with means on said tub rim to support a laterally slidable door, and further comprising means supporting the front portion of said body on said rail.

5. An enclosure as defined in claim 4 and further comprising a riser panel mounted on said rail and extending between said end walls to increase the height of said front wall, and bracket means secured to said end and back walls and including support surfaces defining a common horizontal plane with the top surface of said panel to support said body in enclosing relation with said walls.

* * * * *